US006978105B2

(12) United States Patent
Chung et al.

(10) Patent No.: US 6,978,105 B2
(45) Date of Patent: Dec. 20, 2005

(54) DRUM ASSEMBLY HAVING HELICAL GEAR AND SPUR GEAR SPACED THEREBETWEEN FOR USE IN PRINTER

(75) Inventors: Inho Chung, Seoul (KR); Seungyub Han, Gwangmyeong-si (KR); Minchul Kim, Paju-si (KR)

(73) Assignee: Park & OPC Co., Ltd., Chungcheon buk-do (KR)

( * ) Notice: Subject to any disclaimer, the term of this patent is extended or adjusted under 35 U.S.C. 154(b) by 0 days.

(21) Appl. No.: 10/480,564

(22) PCT Filed: Jan. 27, 2003

(86) PCT No.: PCT/KR03/00176

§ 371 (c)(1),
(2), (4) Date: Dec. 11, 2003

(87) PCT Pub. No.: WO03/062929

PCT Pub. Date: Jul. 31, 2003

(65) Prior Publication Data

US 2004/0156652 A1 Aug. 12, 2004

(30) Foreign Application Priority Data

Jan. 26, 2002 (KR) ..... 10-2002-0004637

(51) Int. Cl.[7] ..... G03G 15/00
(52) U.S. Cl. ..... 399/167
(58) Field of Search ..... 399/167, 117, 116

(56) References Cited

U.S. PATENT DOCUMENTS 6,795,669 B2 * 9/2004 Yamauchi et al. ..... 399/159

FOREIGN PATENT DOCUMENTS

JP 10232526 A * 9/1998 ..... G03G 15/00
JP 2000098809 A * 4/2000 ..... G03G 21/00

* cited by examiner

*Primary Examiner*—Quana Grainger
(74) *Attorney, Agent, or Firm*—Jones Day

(57) ABSTRACT

The present invention relates to a photo-sensitive drum assembly for use in an ink-jet printer or a laser printer.

According to the present invention, there is provided a photo-sensitive drum assembly capable of preventing a helical gear from interrupting a first spur gear while engages with a second spur gear, by placing a gap between the helical gear and the first spur gear, in case that the helical gear which accept the rotational driving force and the first spur gear which transmits the rotational driving force are positioned on a common axis.

4 Claims, 5 Drawing Sheets

DRUM ASSEMBLY HAVING HELICAL GEAR AND SPUR GEAR SPACED THEREBETWEEN FOR USE IN PRINTER

FIELD OF THE INVENTION

The present invention relates to a photo-sensitive drum assembly for forming an image in an image forming apparatus, and more particularly, to a photo-sensitive drum assembly for use in an image forming apparatus not to make a helical gear interrupt a spur gear, which engages with another spur gear, by making a gap between two gears when the helical gear which receives the rotational driving force and the spur gear which transmits the rotational driving force stand parallel are coaxially aligned as a unit.

DESCRIPTION OF THE PRIOR ART

A laser printer, a digital copying machine, an electrophotographic copying machine and a facsimile are generally known as image forming apparatus. These image forming apparatuses form a toner image on a photo-sensitive drum through the processes such as electric charging, light exposure and developing, transfer the toner image onto a record material such as transfer paper, and remove the remaining toner of the photo-sensitive drum with a cleaner.

Such parts as the photo-sensitive drum, a transfer roller, an electric charger, a developing device and the cleaner tend to be produced as one unit for miniaturization, easy maintenance and repair. Further, those parts are manufactured preferably as one unit so as to be detachably inset to the image forming apparatus.

A conventional photo-sensitive drum for use in the image forming apparatus rotates upon receiving rotational driving force from a driving member of the image forming apparatus, and transmits the rotational driving force to other parts e.g., a transfer roller. There are provided flanges on both sides of a cylindrical body of the photo-sensitive drum for use in the image forming apparatus and gears on each side of the flanges. One gear receives the rotational driving force from the driving member, and the other gear transmits the rotational driving force to the gears of the other parts such as a transfer roller.

Another conventional photo-sensitive drum has a flange only on one side of the cylindrical body, and provides the helical gear and the spur gear in a common shaft as a single body so that the photo-sensitive drum can receive the rotational driving force from the helical gear and forces the spur gear to transmit the rotational driving force to a side-attached spur gear, and therefore have the helical gear prevent the photo-sensitive drum from moving in axial direction.

FIG. 1 illustrates the photo-sensitive drum having the helical gear 2 and a $1^{st}$ spur gear 3 on a common shaft 8*a*, and a driving gear 1 which engages with the helical gear 2 and the $1^{st}$ spur gear 3. The photo-sensitive drum also have a $2^{nd}$ spur gear which is mounted to the transfer roller 7.

FIG. 2 provides a side view of FIG. 1, while FIG. 3 provides a front view of FIG. 1.

Referring to both FIG. 1 and FIG. 3, the $1^{st}$ spur gear 3 and the helical gear 2 are attached to the conventional photo-sensitive drum 8 on one side of the common shaft in parallel. The helical gear 2 engages with the driving gear 1 mounted on a driving shaft 5*a* of a driving motor 5 and the $1^{st}$ spur gear 3 engages with the $2^{nd}$ spur gear 4 which is integrally formed with a rotational shaft 7*a* on the side of the transfer roller 7.

The photo-sensitive drum 8 has an advantage of not taking up much room since the photo-sensitive drum 8, as described above, is provided with the helical gear 2 and the $1^{st}$ spur gear 3 in one body. The photo-sensitive drum 8 receives the rotational driving force by using the helical gear 2 and then transmits the rotational driving force by using the $1^{st}$ spur gear 3.

In the conventional photo-sensitive drum 8, however, there exists a danger of interference between the helical gear 2 and the $2^{nd}$ spur gear 4 when the $2^{nd}$ spur gear 4 engaging with the $1^{st}$ spur gear 3 happens to move in the axial direction, since the helical gear 2 and the $1^{st}$ spur gear 3 are positioned close to each other. If the helical gear 2 is interfered with the $2^{nd}$ spur gear during operation, the photo-sensitive drum 8 and the transfer roller 7 are to be placed out of alignment to each other through the interference. This misalignment is a problem that undesirable image is transferred to the transfer paper which passes between the photo-sensitive drum 8 and the transfer roller 7.

Accordingly, to avoid the interference between the helical gear 2 and the $2^{nd}$ spur gear 4, the width of the $2^{nd}$ spur gear should be made as narrow as possible. If the width of the $2^{nd}$ spur gear is narrow, the area wherein the $1^{st}$ spur engages with the $2^{nd}$ spur gear is small and there is a possibility that insufficient driving force is transmitted to the transfer roller 7 by the narrowed $2^{nd}$ spur gear.

Moreover, manufacturing the helical gear 2 and the $1^{st}$ spur gear 3 as a unified body can not be achieved by a general cutting work, but can be achieved by an injection molding Even the injection molding has a demerit of the raised production cost because the injection molding requires high-precision work as high as not to make burr on a boundary line between the helical gear 2 and the $1^{st}$ spur gear 3.

Moreover, polycarbonate has been used in the conventional production of the unified body of the helical gear 2 and the $1^{st}$ spur gear 3 by using the injection molding, but there is still a problem that the production cost is rather high because the polycarbonate is expensive.

SUMMARY OF THE INVENTION

The present invention is provided to solve the above problems.

It is a principal object of the present invention to provide a photo-sensitive drum assembly for use in an image forming apparatus, wherein the interference between the helical gear and the driving force transmitting gears of other parts which is caused by the integral formation of the helical gear and the spur gear is prevented by making a gap between the helical gear and the spur gear which are mounted to a side of the photo-sensitive drum for transmitting the driving force.

It is another object of the present invention to provide a photo-sensitive drum assembly for use in an image forming apparatus, wherein the general cutting work can be used for production and the production cost by the injection molding is reduced.

According to an aspect of the present invention, there is provided a photo-sensitive drum assembly for use in an image forming apparatus, comprising a helical gear for receiving a rotational driving force by engaging with a driving gear of a driving motor; a $2^{nd}$ spur gear attached to a lateral side of a shaft for transmitting the rotational driving force to a transfer roller; and a $1^{st}$ spur gear, engaging with the $2^{nd}$ spur gear, deployed coaxially in parallel to a lateral side in a longitudinal direction, wherein the helical gear is installed next to the $1^{st}$ spur gear with a gap to thereby prevent an interference between the helical gear and the $2^{nd}$ spur gear of the transfer roller moving in an axial direction.

According to another aspect of the present invention, there is provided a photo-sensitive drum assembly for use in an image forming apparatus, comprising: a driving motor; a driving gear for receiving a rotational driving force of the driving motor by being attached to a driving shaft of the driving motor; a helical gear for receiving the rotational driving force originated from the driving motor by engaging with the driving motor; an extended driving shaft which is extended from a central shaft of the helical gear for transmitting the rotational driving force of the helical gear; a photo-sensitive drum, having a cylindrical body, for forming a toner image in conformity with the image of the cylindrical body; a $1^{st}$ spur gear for rotationally driving the photo-sensitive drum, attached to a side of the photo-sensitive drum, one side thereof being attached to the extended shaft of the helical gear coaxially, and being separated from the helical gear by a gap; a transfer roller having a cylindrical body; and a $2^{nd}$ spur gear, connected to a side of the transfer roller through a coupling shaft and engages with the $1^{st}$ spur gear, for transferring an image of the photo-sensitive drum to a transfer paper passing between the transfer roller and the photo-sensitive drum by rotating the transfer roller engaged with the photo-sensitive drum.

BRIEF DESCRIPTION OF THE DRAWINGS

The above and other objects and features of the present invention will become apparent from the following description of the preferred embodiments given in conjunction with the accompanying drawings, in which.

DETAILED DESCRIPTION OF THE INVENTION

Hereinafter, preferred embodiments of the present invention will be explained with reference to the accompanying drawings, wherein like numerals refer to like parts throughout.

Figure 1:
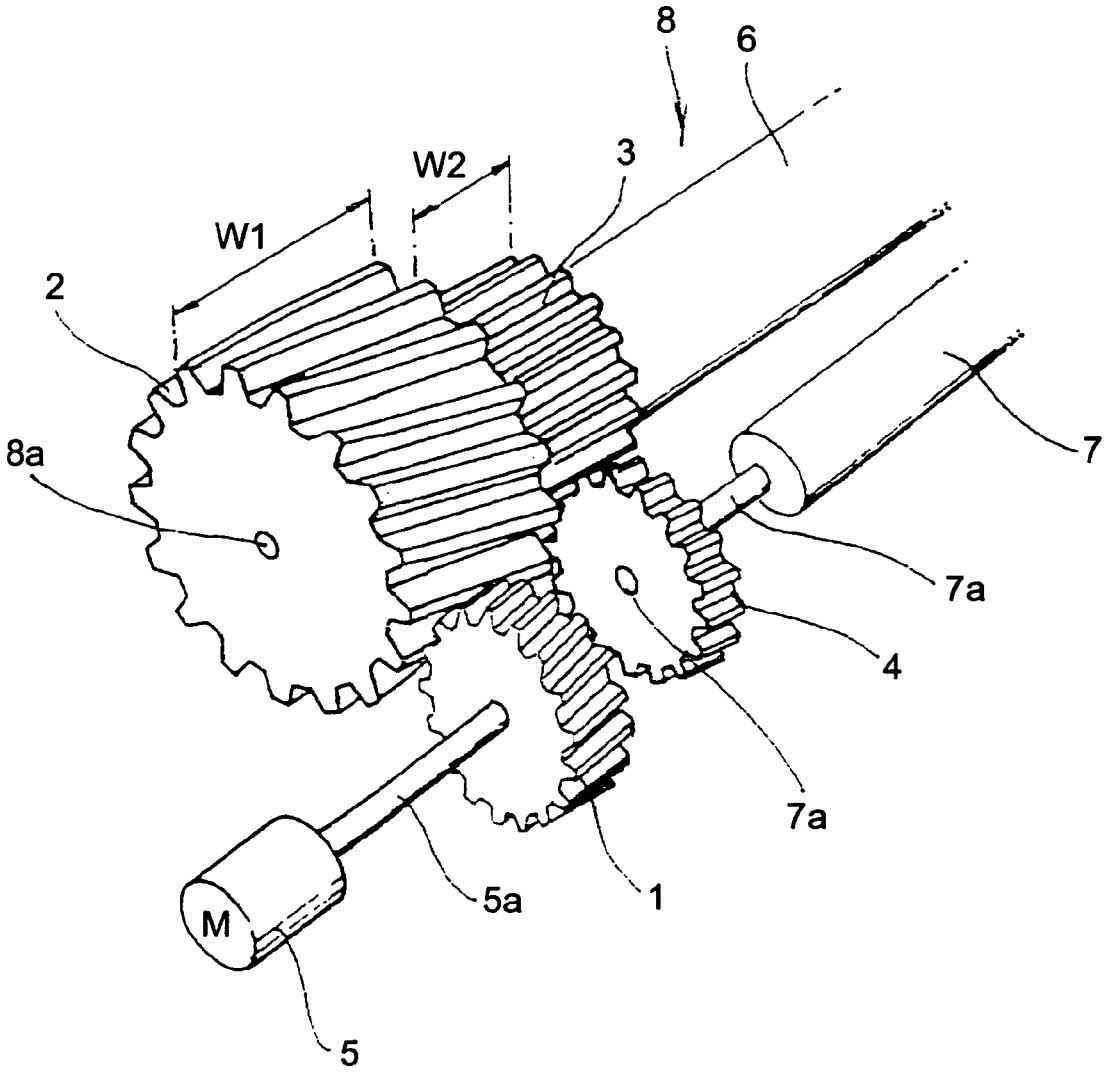
Fig. 1 (PRIOR ART)
FIG. 1 is a perspective view of a conventional photo-sensitive drum assembly.
Figure 2:
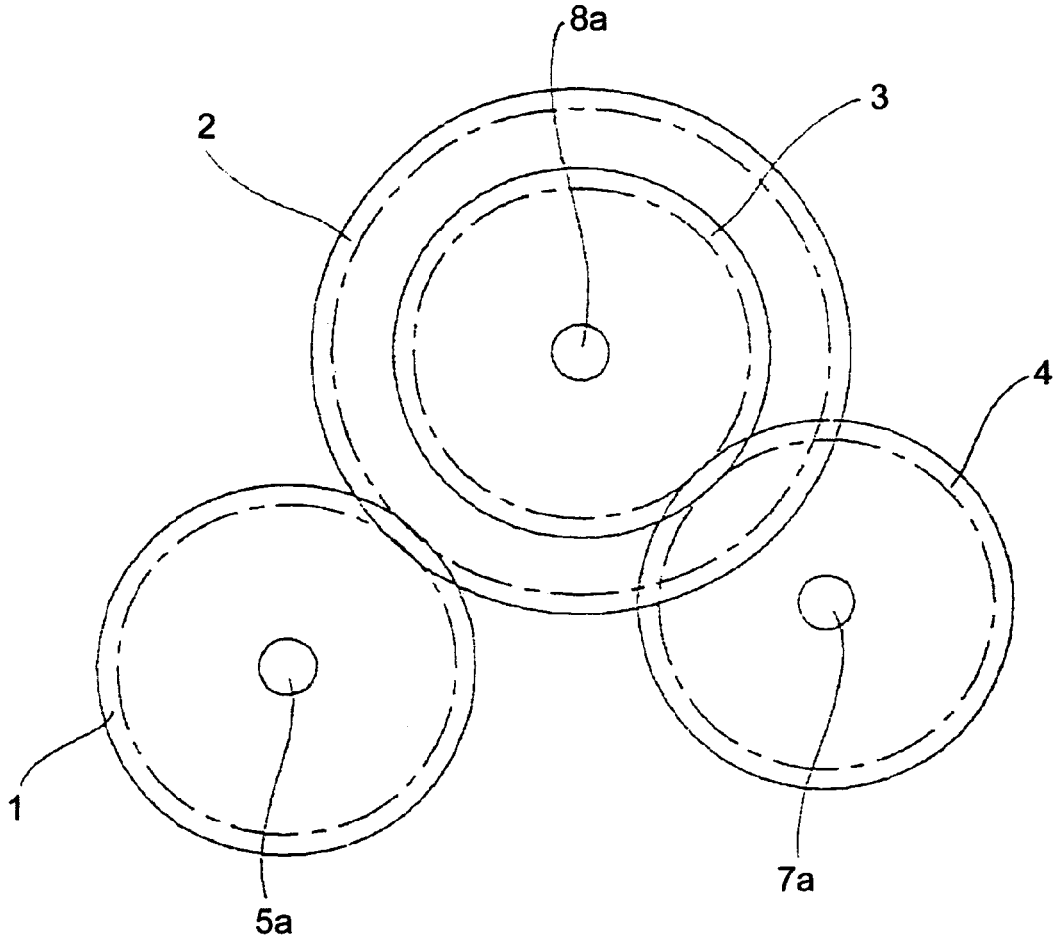
Fig. 2 (PRIOR ART)
FIG. 2 is a side view of a conventional photo-sensitive drum assembly.
Figure 3:
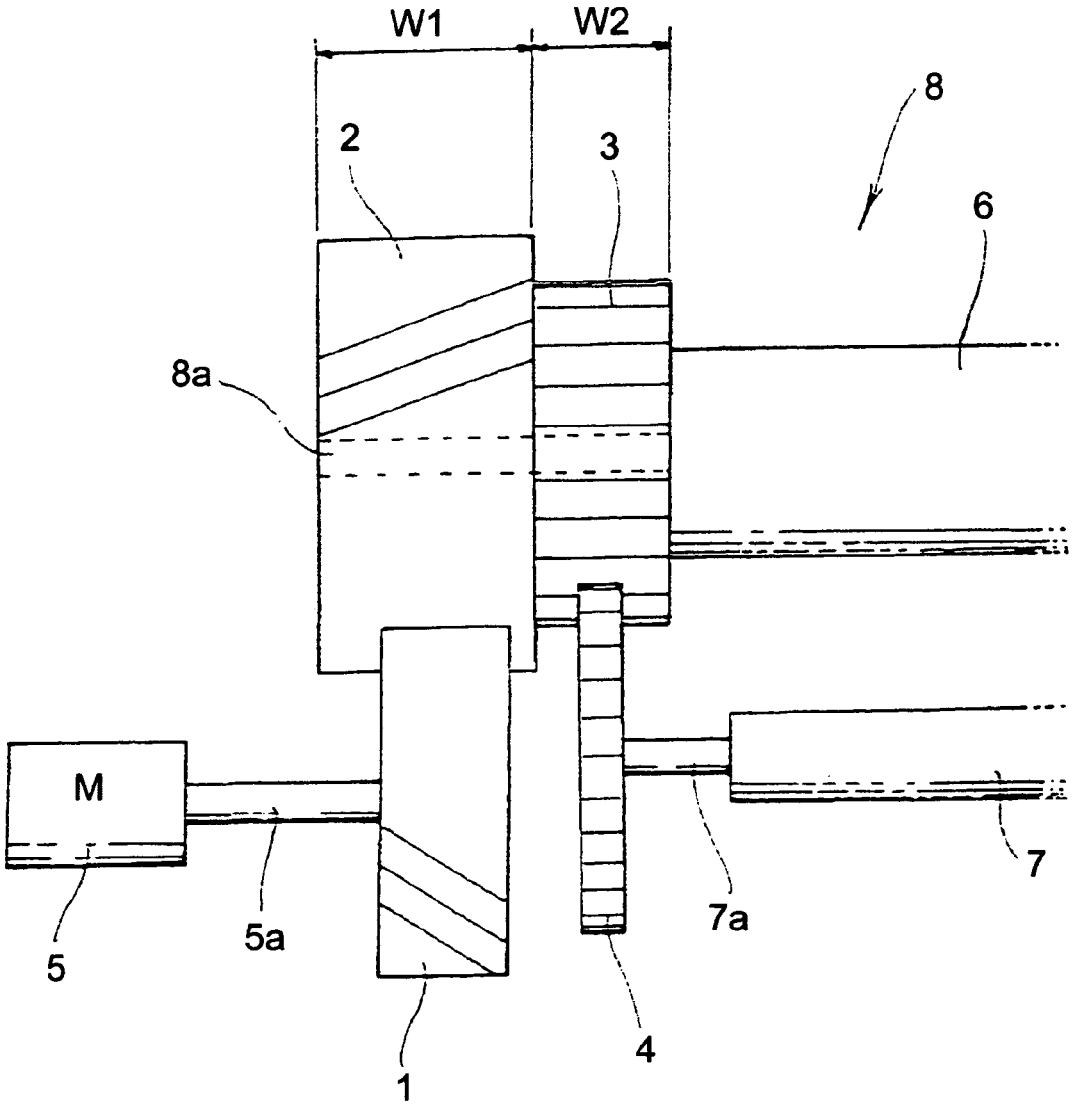
Fig.3 (PRIOR ART)
FIG. 3 is a front view of a conventional photo-sensitive drum assembly.
Figure 4:
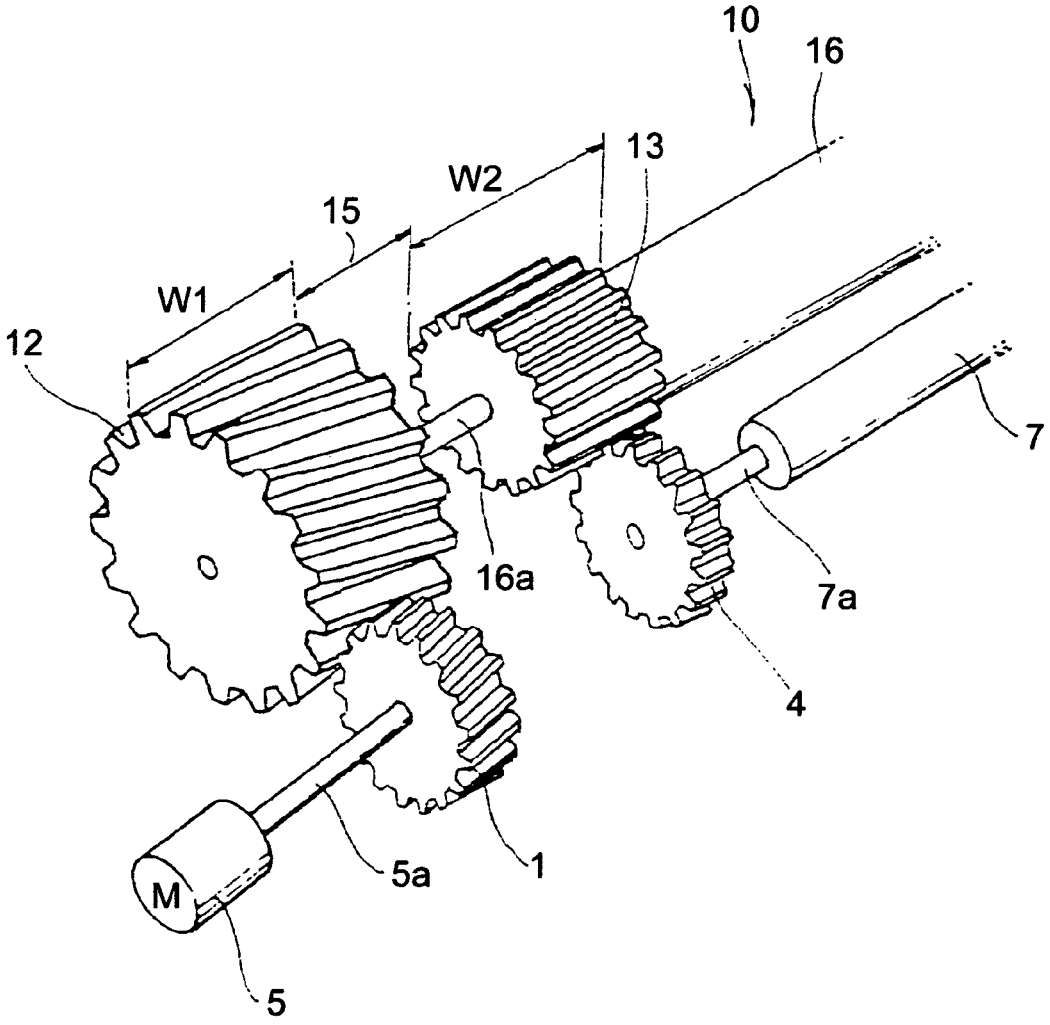
FIG. 4 is a perspective view of a photo-sensitive drum assembly in accordance with a preferred embodiment of the present invention.
Figure 5:
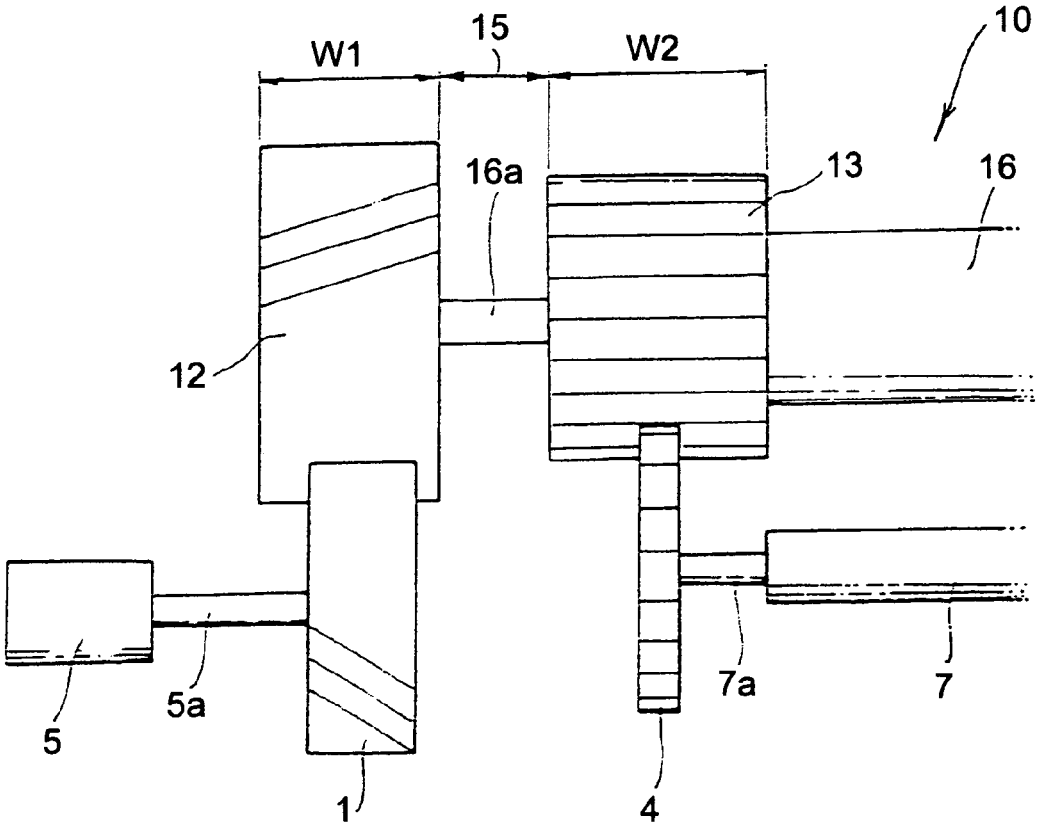
FIG. 5 is a front view of photo-sensitive drum assembly in accordance with a preferred embodiment of the present invention.

FIG. 4 and FIG. 5 are a perspective view and a front view, respectively of a photo-sensitive drum assembly 10, in accordance with a preferred embodiment of the present invention.

The photo-sensitive drum assembly 10 of the present invention includes a driving motor 5, a driving gear 1 receiving a rotational driving force from the driving motor 5 by being attached to a driving shaft 5*a* of the driving motor 5, a helical gear 12 which accepts the rotational driving force originated from the driving motor 5 by engaging with the driving motor 5, an extended driving shaft 16*a* extending from the central shaft of the helical gear 12 for transmitting the rotational driving force of the helical gear 12, a photo-sensitive drum 16, having a cylindrical body and for forming the toner image in conformity with the image in the cylindrical body, a $1^{st}$ spur gear 13 which rotationally drives the photo-sensitive drum 16, one side thereof being attached to the side of the photo-sensitive drum 16 and the other side thereof attached coaxially to the extended driving shaft 16*a* of the helical gear 12, a transfer roller 7 which has a cylindrical body, and a $2^{nd}$ spur gear 4 which is attached to one side of the transfer roller 7 by the coupling shaft 7*a* and rotates the transfer roller 7 in conformity of the rotation of the photo-sensitive drum 16 by engaging with the $1^{st}$ spur gear 13.

As illustrated in FIG. 4 and FIG. 5, referring to the photo-sensitive drum 10 according to the preferred embodiment of the present invention, the helical gear 12 engages with the driving gear 1 that is unified with the driving shaft 5*a* of the driving motor 5, and the $1^{st}$ spur gear 13 is attached to the extended driving shaft 16*a* on the common shaft so the $1^{st}$ spur gear 13 is separated with as much as a gap 15 from the helical gear 12 through the extended driving shaft 16*a* of the helical gear 12. Also, the $1^{st}$ spur gear 13 engages with the $2^{nd}$ spur gear 4, and the transfer roller 7 is attached to the driving shaft 7*a* of the $2^{nd}$ spur gear 4. Herein, the gap 15 is properly determined by the relative positions of the transfer roller 7 and the $2^{nd}$ spur gear 4. An image is formed on a transfer paper which passes between the photo-sensitive drum 16 and the transfer roller 7 by transcribing the toner image of the photo-sensitive drum 16 thereon while the photo-sensitive drum 16 and the transfer roller 7 rotate engaged with each other.

The transfer roller 7, while in operation, happens to move in the longitudinal direction of the central shaft 7*a* as mentioned above, and due to this movement the $2^{nd}$ spur gear 4 moves in the longitudinal direction of the central shaft 7*a*. In an effort to maintain engagement with the $2^{nd}$ spur gear, the $1^{st}$ spur gear 13 should have a minimum width to ensure the engagement.

In the embodiment of the present invention, the $1^{st}$ spur gear 13 of 5 mm wide is used and the gap 15 between the helical gear 12 and the $1^{st}$ spur gear 13 is set to 3 mm.

A danger of interference between the $2^{nd}$ spur gear 7 and the helical gear 12 can be reduced by the gap 15 though the transfer roller 7 moves in the longitudinal direction during operation.

Further, the $2^{nd}$ spur gear 4 receives more rotational driving force from the $1^{st}$ spur gear 13 since the $2^{nd}$ spur gear 4 can be formed wider to the extent of the gap 15.

During operation, various kinds of alien substances, especially such as a toner, are held in or taken off from the narrow space between gear teeth of the helical gear 12 repeatedly. But in accordance with the present invention, the substance, taken off from the teeth of the helical gear 12 during operation, is discharged through the gap 15. Therefore the trouble of interference of the engagement of the gears by alien substances disappears.

As stated above, the production of the helical gear 12 attaching to the side of the $1^{st}$ spur gear 13 cannot be done with a cutting work. In order to produce the helical gear 12, an injection molding is inevitably necessary, while the injection molding raises the production cost because the injection molding requires so much highly accurate work as not to make burr in a boundary face between the helical gear 2 and the $1^{st}$ spur gear 3.

As provided in the present invention, however, if the gap 15 is made between the helical gear 12 and the $1^{st}$ spur gear 13, the cutting work becomes applicable. Further, because the gap also prevents the edge of the gear tooth from the burr, the injection molding of the highly accurate work is no more necessary and the production cost doesn't rise so high.

When the helical gear 12 and the $1^{st}$ spur gear 13 are produced by the injection molding, polyacetal or polycarbonate is generally used. However the unit cost of polyacetal and polycarbonate is so high that the production cost considerably depends on the amount of polyacetal and polycarbonate used.

In accordance with the present invention, the polycarbonate is used in the production of the helical gear 12 and the $1^{st}$ spur gear 13 of the photo-sensitive drum 10.

Conventionally, to secure the transmission of the rotational driving force of the driving gear 1 to the $2^{nd}$ spur gear 14, the tooth width w1 of the helical gear 12 has been made wider than the tooth width w2 of the $1^{st}$ spur gear 13.

In the preferred embodiment in accordance with the present invention, the tooth width w1 of the helical gear 12 is made smaller than or equal to the tooth width w2 of the $1^{st}$ spur gear 13. More specifically, in the photo-sensitive drum 10 according to the present invention, the tooth width w1 of the helical gear 12 was embodied in two ways, one with 4 mm and the other with 5 mm, while fixing the tooth width w2 of the $1^{st}$ spur gear to 5 mm. Considering the longitudinal movement of the $2^{nd}$ spur gear 4, the tooth width w2 of the $1^{st}$ spur gear 13 is set to 5 mm, at the minimum.

In two examples explained above, the secure transmission of the rotational driving force is achieved in the photo-sensitive drum 10 according to the present invention, and accordingly, it is possible for the tooth width w1 of the helical gear 12 to be made smaller than or equal to the tooth width w2 of the $1^{st}$ spur gear 13.

INDUSTRIAL APPLICATION

As described above, according to the photo-sensitive drum assembly for use in an image forming apparatus of the present invention, the extended driving shaft is attached to the helical gear and the separate gap between the helical gear and the $1^{st}$ spur gear is formed by attaching the $1^{st}$ spur gear to the extended driving shaft, so that if the transfer roller moves in the longitudinal direction, an excellent image can be provided on the transfer paper since the interference between the helical gear and the $2^{nd}$ spur gear is prevented.

Additionally, according to the photo-sensitive drum for use in an image forming apparatus of the present invention, the alien substances which are taken off from the space between teeth of the helical gear and the $1^{st}$ spur gear are eliminated from the gears through the gap, so that there is an effect that the gap prevents the interference of the engagement of the gears by alien substances.

Furthermore, according to the photo-sensitive drum for use in an image forming apparatus of the present invention, there is no problem in the transmission of the rotational driving force in spite of forming the tooth width of the helical gear smaller than the tooth width of the $1^{st}$ gear.

Further additionally, since the used polycarbonate can be reduced as much as the reduced width of the tooth of the helical gear 12, the production cost can be reduced.

While the invention has been shown and described with respect to the preferred embodiments, it will be understood by the skilled in the art that various changes and modifications may be made without departing from the scope of the inventions as defined in the following claims.

What is claimed is:

1. A photo-sensitive drum assembly for use in an image forming apparatus, comprising:

a helical gear for receiving a rotational driving force by engaging with a driving gear of a driving motor;

a second spur gear attached to a lateral side of a shaft for transmitting the rotational driving force to a transfer roller; and a first spur gear, engaging with the second spur gear, deployed coaxially in parallel to a lateral side in a longitudinal direction, wherein the helical gear is installed next to the first spur gear with a gap to thereby prevent an interference between the helical gear and the second spur gear of the transfer roller moving in an axial direction, wherein the tooth width w1 of the helical gear is lesser than or equal to the tooth width w2 of the first spur gear.

2. The photo-sensitive drum assembly according to claim 1, wherein the tooth width w1 of the helical gear is between 0.8 and 1.0 times of the tooth width w2 of the first spur gear.

3. A photo-sensitive drum assembly for use in an image forming apparatus, comprising:

a driving motor;

a driving gear for receiving a rotational driving force of the driving motor by being attached to a driving shaft of the driving motor;

a helical gear for receiving the rotational driving force originated from the the driving motor by engaging with the driving motor;

an extended driving shaft which is extended from a central shaft of the helical gear for transmitting the rotational driving force of the helical gear;

a photo-sensitive drum, having a cylindrical body, for forming a toner image in conformity with the image of the cylindrical body;

a first spur gear for rotationally driving the photo-sensitive drum, attached to a side of the photo-sensitive drum, one side thereof being attached to the extended shaft of the helical gear coaxially, and being separated from the helical gear by a gap;

a transfer roller having a cylindrical body; and a second spur gear, connected to a side of the transfer roller through a coupling shaft and engages with the first spur gear, for transferring an image of the photo-sensitive drum to a transfer paper passing between the transfer roller and the photo-sensitive drum by rotating the transfer roller engaged with the photo-sensitive drum, wherein the tooth width of the helical gear is less than or equal to the tooth width of the first spur gear.

4. The photo-sensitive drum assembly according to claim 3, wherein the tooth width of the helical gear is between 4 mm and 5 mm and the tooth width of the first spur gear is 5 mm.

* * * * *